US005985440A

United States Patent [19]

Weise et al.

[11] Patent Number: 5,985,440

[45] Date of Patent: Nov. 16, 1999

[54] SINTERED SILVER-IRON MATERIAL FOR ELECTRICAL CONTACTS AND PROCESS FOR PRODUCING IT

[75] Inventors: Wolfgang Weise, Frankfurt; Willi Malikowski, Aschaffenburg; Roger Wolmer, Gelnhausen; Peter Braumann, Alzenau; Andreas Koffler, Nidderau, all of Germany

[73] Assignee: Degussa Aktiengesellschaft, Frankurt, Germany

[21] Appl. No.: 08/806,725

[22] Filed: Feb. 27, 1997

[30] Foreign Application Priority Data

Feb. 27, 1996 [DE] Germany ..... 196 07 183

[51] Int. Cl.[6] ..... B22F 3/00; B22F 3/26; B22F 7/00; H01H 1/02

[52] U.S. Cl. ..... 428/346; 428/567; 428/568; 428/673; 428/929; 200/265; 200/266; 75/232; 75/235; 75/236; 75/246; 419/38; 419/41; 419/42; 419/13; 419/14; 419/21

[58] Field of Search ..... 428/546, 567, 428/568, 673, 929; 419/4, 13, 14, 21, 38, 41, 42; 75/951, 232, 235, 236, 246; 200/265–66

[56] References Cited

U.S. PATENT DOCUMENTS

| | | | |
|---|---|---|---|
| 3,708,283 | 1/1973 | Hill | 75/200 |
| 4,457,780 | 7/1984 | Osada et al. | 75/236 |
| 4,937,041 | 6/1990 | Deffeyes | 419/19 |
| 5,422,065 | 6/1995 | Hauner et al. | 420/501 |

FOREIGN PATENT DOCUMENTS 144 959 6/1985 European Pat. Off. .

*Primary Examiner*—Paul Thibodeau
*Assistant Examiner*—Holly Rickman
*Attorney, Agent, or Firm*—Smith, Gambrell & Russell

[57] ABSTRACT

Sintered silver-iron material for electrical contacts, with properties comparable with those of silver-nickel materials, is obtained by using iron powder having more than 0.25% carbon by weight and microhardness higher than 200 HV 0.025 and sintering in a hydrogen-free protective gas.

15 Claims, No Drawings

SINTERED SILVER-IRON MATERIAL FOR ELECTRICAL CONTACTS AND PROCESS FOR PRODUCING IT

INTRODUCTION AND BACKGROUND

The invention concerns a sintered silver-iron material with 0.5 to 20% iron by weight and 0 to 5% by weight other metal, oxide, nitride, and/or carbide additives, the remainder being silver, which is useful for electrical contacts, and a process for producing this material.

Electrical switching contacts include stationary and moving conducting surfaces that make and/or break electric circuits. The choice of materials depends on the application. Common contact materials include palladium, silver, gold, mercury, and various alloys. Plated and overlaid surfaces of other metals such as nickel or rhodium are used to impart special characteristics such as long wear and arc resistance or to limit corrosion.

Materials for electrical switching contacts can be prepared by powder metallurgy. Powder metallurgy is the process of manufacturing articles from metallic powders. Powder metallurgy involves three main processes. First, the metal or alloy powder must be prepared. Second, the powder must be compacted in order to have sufficient strength for handling. Third, the resulting compacted material must be heated at a high temperature in a controlled atmosphere for such a time that the density of the compact increases to the desired value.

The purpose of the powder compaction process is to bring the individual powder particles into very intimate contact so that metal-to-metal bonding takes place. This compaction confers a small amount of mechanical strength and facilitates the mass transfer that must occur later during sintering to produce densification. Sintering involves compressing metal particles into a solid under heat, but at a temperature below their melting point.

After compaction, the material is heated at a high temperature in a controlled atmosphere. During sintering, the voids within the compact are progressively eliminated by atom movements and eventually a dense compact is produced practically free from porosity.

Sintering times vary and the sintering temperature is generally not less than two thirds of the melting point of the metal in degrees Kelvin. Sometimes the temperature is much more than this.

Contact materials for use in .he electrical power industry must have high resistance to burning [contact erosion], low sticking force [low contact welding force] and low contact resistance. Silver-nickel composite has proved useful for switches in air for low-voltage systems with switched currents of less than 100 A. It has high resistance to burning and very good over-heating behavior. One disadvantage of the material, though, is that nickel, especially in dust form, can be harmful to humans. For this reason, there have been various suggestions for use of iron as an alternative to nickel.

Electrical contact materials which contain iron, nickel, chromium, and/or cobalt along with silver are known from Japanese patent application 79/148109. Materials having the composition Ag and Fe (10%) have high resistance to contact welding while retaining good electrical conductivity.

Silver-iron materials for special contact applications are 41 also described in the journal "Materials and Methods," Vol. 44, No. 3, September 56, pages 121–126. Silver contact materials containing 0.001 to 1% nickel, iron, molybdenum, cobalt, chromium, titanium and/or vanadium, along with silver and the component that is oxidized are known from German patent application 11 53 178. German patent application 11 06 965 describes a process for producing dense sintered shapes from silver with 5 to 50% of at least one of the metals vanadium, tantalum, chromium, molybdenum, tungsten, iron, cobalt or nickel. They can also be used as contact materials.

Silver-iron materials have not been used more widely because they tend to form coatings during switching, thus producing high contact heating. None of these materials match the favorable properties of the sintered silver-nickel material.

All the known silver-iron materials for electrical contacts are made from standard commercial iron powder with a carbon content of less than 0.05%, so that they are relatively soft. The sintering is usually carried out in a hydrogen-containing atmosphere, particularly in nitrogen-hydrogen mixtures.

Therefore it is an objective of this invention to develop a sintered silver-iron material containing 0.5 to 20% by weight iron and 0 to 5% by weight of other metallic, oxidic, nitridic, and/or carbidic additives, the remainder being silver, which is useful for electrical contacts. Such a material should have little tendency to weld, low contact resistance, and high resistance to burning, so as to have a long lifetime. Its properties should approach as nearly as possible those of the known silver-nickel contact materials. A further objective is to develop a process for producing such a material.

SUMMARY OF THE INVENTION

In achieving the above and other objectives, a feature of the invention resides in a sintered silver-iron material for electrical switching contacts comprising particles having a carbon content, in the sintered material, of more than 0.25% by weight, and which have a microhardness of more than 200 HV 0.025.

A further feature of the invention resides in a method of producing sintered silver-iron materials, which are produced by mixing silver powder with 0.5 to 20% by weight iron powder and 0 to 5% by weight of other metallic, oxidic, nitridic and/or carbidic additives, cold isostatic pressing, sintering at 650° C. to 940° C. under a protective gas, and extruding. The iron powder according to the invention contains more than 0.25% carbon by weight, and the sintering must be done in a protective gas atmosphere which does not contain any hydrogen.

DETAILED DESCRIPTION OF THE INVENTION

It has now been found, surprisingly, according to the invention that a sintered silver-iron material comprising silver and iron present in an amount of 0.5 to 20% by weight wherein the iron powder contains more than 0.25% carbon by weight, both in the initial state and after sintering, so that it has a microhardness higher than 200 HV 0.025 results in a material with distinctly improved overheating behavior in practical use. The iron particles, according to the invention, preferably have a carbon content of more than 0.4% by weight and a microhardness higher than 400 HV 0.025 in the sintered material. The iron particles, most preferably have a carbon content in the sintered state of 0.6 to 1.2% by weight and a microhardness higher than 600 HV 0.025, for example, having carbon present in an amount of 0.9% and having a microhardness of 800 HV 0.025. The material of this invention must be sintered in a hydrogen-free protective gas to maintain the carbon content above 0.25% by weight and thus maintain the desired microhardness in the sintered state. This process assures that the carbon content of the iron powder is not reduced in sintering.

The silver-iron material according to the invention has practically the same lifetime and other properties as silver-nickel materials.

From 0 to 5% by weight metal additives, such as zinc, copper, manganese, rhenium, iridium and ruthenium, or non-metal additives such as magnesium oxide, tin oxide, tungsten oxide, molybdenum oxide, iron oxide, magnesium oxide, calcium oxide, yttrium oxide, aluminum oxide, indium oxide, silicon oxide and zirconium oxide, may be added to the silver-iron materials.

Surprisingly, it has been found that the materials according to the invention are actually easier to work. This result occurs because the iron in the silver matrix is distinctly more finely divided during extrusion, and the iron, because of its brittleness, does not deform into elongated bands of iron, as happens in the known silver-iron materials. The materials can be produced economically, and all their switching properties are comparable with the silver-nickel material. In particular, the overheating and lifetime values match those of silver-nickel materials.

A further feature of the invention is a process for producing sintered material that comprises the following steps:

mixing silver powder and 0.5 to 20% by weight iron powder to form a mixture; cold isostatic pressing the mixture; and sintering the pressed mixture in a hydrogen-free protective gas environment at 650 to 940° C.; wherein said iron powder contains carbon in an amount greater than 0.25% by weight. The process further comprises extruding the sintered material. Preferably, the hydrogen-free protective gas environment is a hydrogen-free nitrogen environment. The iron particles in said sintered material have a microhardness greater than 200 HV 0.025.

A further feature of the invention is a sintered material produced from the above process.

EXAMPLES

The advantageous results of this invention were demonstrated by electrical switching tests with standard contacts. The tests were carried out according to DIN VDE 0660 at 5.5 kW with AC4 circuit conditions. The overheating measurement was done at the contact junctions at a current of 20 A after every 20,000 switching cycles. The following table shows the materials and their results of switching tests with those materials after a total switching stress of 60,000 cycles. The data show the improvement in contact heating of the materials according to the invention (No. 6 to 16) over the known materials, Ag and Ni (20%) (No. 1), and Ag, Fe (9.5%), and Zn (1.5%) (No. 2) and over materials using conventional iron powders containing less than 0.1% carbon by weight (No. 3 to 5).

| No. | Material | Average overheating in K | Lifetime |
|---|---|---|---|
| 1 | Ag and Ni (20%) | 90 | 110,000 |
| 2 | Ag, Fe (8.5%) and Zn (1.5%) | 116 | 95,000 |
| 3 | Ag and Fe (8%) | 130 | 95,000 |
| 4 | Ag, Fe (8%) and Re (5%) | 95 | 90,000 |
| 5 | Ag, Fe (6%) and MgO (0.5%) | 95 | 90,000 |
| 6 | Ag, Fe (8.5%) and Zn (1.5%) | 110 | 110,000 |
| 7 | Ag and Fe (6%) | 110 | 110,000 |
| 8 | Ag, Fe (6%) and Re (0.5%) | 80 | 100,000 |
| 9 | Ag, Fe (4%) and MgO (0.5%) | 80 | 105,000 |
| 10 | Ag and Fe (4%) | 80 | 100,000 |
| 11 | Ag and Fe (10%) | 120 | 125,000 |
| 12 | Ag, Fe (8%) and $Al_2O_3$ (0.5%) | 95 | 110,000 |
| 13 | Ag, Fe (8%) and $SnO_2$ (0.5%) | 90 | 110,000 |
| 14 | Ag, Fe (8%) and $SiO_2$ (0.5%) | 90 | 115,000 |
| 15 | Ag, Fe (8%) and Ir (0.5%) | 95 | 125,000 |
| 16 | Ag, Fe (8%) and Ru (0.5%) | 90 | 115,000 |

The following examples show the production of the materials according to the invention. The iron powder used in both cases contained about 0.9% carbon by weight and had a hardness of about 800 HV 0.025.

1. 80 g iron powder is mixed with 920 g silver powder. The mixture is isostatically pressed cold to produce a billet for extrusion. The billet is sintered at 850° C. in hydrogen-free nitrogen, and extruded to a wire 8 mm in diameter. The wire is further shaped by drawing to the desired final diameter.

2. 80 g iron powder and 5 g rhenium powder are mixed with 915 g silver powder. The mixture is isostatically pressed cold to produce a billet for extrusion. The billet is sintered at 850° C. in hydrogen-free nitrogen and extruded to a wire 8 mm in diameter. The wire is further shaped by drawing to the desired final diameter.

The wires could always be processed well into contacts.

Further variations and modifications of the foregoing will be apparent to those skilled in the art and are intended to be encompassed by the claims appended hereto.

German priority application 196 07 183.6 is relied on and incorporated herein by reference.

What is claimed:

1. A sintered material for electrical contacts comprising a mixture of silver particles;

iron particles present in an amount of 0.5 to 20% by weight; and rhenium present in an amount of 0.5% to 5% by weight, wherein said iron particles in said sintered material comprise carbon present in an amount greater than 0.25% by weight;

wherein said iron particles have a microhardness of greater than 200 HV 0.025, wherein said silver particles and said iron particles form a mixture which is sintered at a temperature below the melting point of silver and iron.

2. The sintered material as defined in claim 1 wherein rhenium is present in an amount of 0.5% by weight.

3. Sintered material for electrical contacts consisting essentially of a mixture of silver particles;

carbon containing iron particles present in an amount of 0.5 to 20% by weight; and at least one metal additive selected from the group consisting of zinc, copper, manganese, rhenium, iridium, and ruthenium present in an amount of 5% or less;

wherein carbon in said carbon-containing iron particles in said sintered material is present in an amount greater than 0.25% by weight;

wherein said iron particles have a microhardness of greater than 200 HV 0.025;

wherein said silver particles and said iron particles form a mixture which is sintered at a temperature below the melting point of silver and iron.

4. The sintered material as defined in claim 3 wherein said carbon is present in an amount greater than 0.4% by weight; and wherein said microhardness is higher than 400 HV 0.025.

5. The sintered material as defined in claim 4 wherein said carbon is present in an amount of 0.6 to 1.2% by weight; and wherein said microhardness is higher than 600 HV 0.025.

6. The sintered material as defined in claim 5 wherein said carbon is present in an amount of 0.9% by weight; and wherein said microhardness is 800 HV 0.025.

7. Sintered material for electrical contacts consisting essentially of a mixture of silver particles;

carbon containing iron particles present in an amount of 0.5 to 20% by weight;

wherein carbon in said carbon-containing iron particles in said sintered material is present in an amount greater than 0.25% by weight;

wherein said iron particles have a microhardness of greater than 200 HV 0.25;

wherein said silver particles and said iron particles form a mixture which is sintered at a temperature below the melting point of silver and iron;

at least one metal additive selected from the group consisting of zinc, copper, manganese, rhenium, iridium, and ruthenium present in an amount of 5% or less or non-metal additive present in an amount of 5% or less; and wherein said nonmetal additive is selected from the group consisting of oxides, nitrides, and carbides.

8. The sintered material as defined in claim 7 wherein said oxides are selected from the group consisting of magnesium oxide, tin oxide, tungsten oxide, molybdenum oxide, yttrium oxide, aluminum oxide, indium oxide, silicon oxide, and zirconium oxide.

9. A process for producing sintered material comprising mixing silver powder and 0.5 to 20% by weight iron powder to form a mixture;

cold isostatic pressing said mixture; and sintering said pressed mixture in a hydrogen-free protective gas environment at 650 to 940° C.;

wherein said iron powder contains carbon in an amount greater than 0.25% by weight, and wherein said iron powder has a microhardness of greater than 200 HV 0.025.

10. A process for producing sintered material as described in claim 9 further comprising extruding said sintered material.

11. A process for producing sintered material as described in claim 9 wherein said hydrogen-free protective gas environment is a nitrogen environment.

12. A process for producing sintered material as defined in claim 9 wherein said pressed mixture forms a billet;

wherein said billet is sintered in a hydrogen-free nitrogen environment; and at lease one metal or non-metal additive present in an amount of 5% or less; and wherein said non-metal additive is selected from the group consisting of oxides, nitrides, and carbides.

13. A process for producing sintered material defined in claim 3 comprising mixing said silver particles, said iron particles, and said metal additive to form a mixture;

cold isostatic pressing said mixture; and sintering said pressed mixture in a hydrogen-free protective gas environment at 650 to 940° C.

14. A process for producing sintered material defined in claim 7 comprising mixing said silver particles, said iron particles, and said metal additive or non-metal additive to form a mixture;

cold isostatic pressing said mixture; and sintering said pressed mixture in a hydrogen-free protective gas environment at 650 to 940° C.

15. A process for producing sintered material defined in claim 8 comprising mixing said silver particles, said iron particles, and said metal additive or said non-metal additive to form a mixture;

cold isostatic pressing said mixture; and sintering said pressed mixture in a hydrogen-free protective gas environment at 650 to 940° C.

* * * * *